US007549290B2

(12) United States Patent
Holt et al.

(10) Patent No.: US 7,549,290 B2
(45) Date of Patent: Jun. 23, 2009

(54) ACOUSTIC DAMPER

(75) Inventors: Alistaire S Holt, Derby (GB); Michael A MacQuisten, Derby (GB); Michael Whiteman, Loughborough (GB); Anthony J Moran, Nuneaton (GB)

(73) Assignee: Rolls-Royce plc, London (GB)

( * ) Notice: Subject to any disclaimer, the term of this patent is extended or adjusted under 35 U.S.C. 154(b) by 618 days.

(21) Appl. No.: 11/259,268

(22) Filed: Oct. 27, 2005

(65) Prior Publication Data

US 2006/0207259 A1 Sep. 21, 2006

(30) Foreign Application Priority Data

Nov. 24, 2004 (GB) ..... 0425794.5

(51) Int. Cl.
*F23R 3/06* (2006.01)
*F23M 5/00* (2006.01)

(52) U.S. Cl. ..... 60/725; 60/754; 60/755; 431/114

(58) Field of Classification Search ..... 60/772, 60/725, 755, 757, 784; 431/114
See application file for complete search history.

(56) References Cited

U.S. PATENT DOCUMENTS

| | | | | |
|---|---|---|---|---|
| 5,799,491 | A * | 9/1998 | Bell et al. | 60/754 |
| 6,351,947 | B1 | 3/2002 | Keller | |
| 6,408,629 | B1 * | 6/2002 | Harris et al. | 60/754 |
| 6,964,170 | B2 * | 11/2005 | Alkabie | 60/725 |
| 2004/0060295 | A1 | 4/2004 | Mandai | |
| 2005/0034918 | A1 | 2/2005 | Bland | |
| 2005/0223707 | A1 * | 10/2005 | Ikeda et al. | 60/725 |

FOREIGN PATENT DOCUMENTS

| | | | |
|---|---|---|---|
| EP | 0 576 717 | A | 7/1992 |
| EP | 0 971 172 | A | 7/1998 |
| EP | 0 990 851 | A | 4/2000 |
| EP | 1 213 539 | A | 6/2002 |
| EP | 1 251 313 | A | 10/2002 |
| GB | 2 390 150 | A | 12/2003 |
| GB | 2390150 | * | 12/2003 |
| JP | 2003214185 AB | | 1/2002 |
| WO | WO 02/25174 | A | 3/2002 |
| WO | WO 2004/051063 | * | 6/2004 |

* cited by examiner

*Primary Examiner*—Ted Kim
(74) *Attorney, Agent, or Firm*—W. Warren Taltavull; Manelli Denison & Selter PLLC

(57) ABSTRACT

A combustor wall of a gas turbine engine is provided with an acoustic damper component. The component has a first metering passage, a first damping chamber, a first damping passage, a second damping chamber and a second damping passage. Air flows through the damper to be ejected into the combustion chamber from the second damping passage at a selected velocity and volumetric flow. The flow being sufficient to damp instabilities from the combustion process.

10 Claims, 4 Drawing Sheets

ACOUSTIC DAMPER

FIELD OF THE INVENTION

This invention relates to an acoustic damper. More particularly this invention is concerned with an acoustic damper for a combustion chamber, and even more particularly for a combustion chamber of a gas turbine.

BACKGROUND OF THE INVENTION

The modern gas turbine engine is subject to both environmental and efficiency pressures. The engine must produce no or minimal levels of environmental pollutants such as NOx (oxides of nitrogen), CO (carbon monoxide), UHC (unburnt hydrocarbons) and smoke.

CO and UHC are produced as a cause of combustion inefficiency, whilst NOx and smoke emissions are caused by high temperatures and a slightly weaker than stoichiometric fuel to air ratio and richer than stoichiometric fuel to air ratio respectively.

In a lean-burn combustor, the flow of air into the combustor is increased such that the fuel to air ratio is below the level at which NOx is formed. The addition of extra air has the added effect of reducing the localised temperature of the gases formed by the combusted fuel, similarly minimising the chance for NOx to be formed.

One problem with lean-burn combustors is that the increased airflow can cause instability in the combustion process that results in high fluctuating pressure amplitudes at a frequency below 1000 Hz, and more particularly in the region of 600 to 800 Hz. The high fluctuating pressure amplitudes can cause hardware damage to the combustion chamber itself.

Combustion chambers may be cooled by a flow of air into the chamber through perforations in the wall of the chamber. The injected air, from holes commonly known as effusion holes, forms a film of relatively cold air over the inner surface of the combustor and reduces the value of the convective heat transfer between the flame and the combustor wall. The film must be uniform to prevent localised hot-spots and to ensure that the temperature of the wall is below the melting point of the material from which it is manufactured.

It has been proposed that the flow of air through the effusion holes may also be used to provide damping of instabilities in the combustion process.

The amount of air flowing through a turbine engine is limited and, where a lean burn combustor is provided, the additional air used in the combustion process constrains the amount of air available for damping and cooling purposes. Additionally, a flow of air providing a cooling function has different characteristics to a flow of air providing a damping function. Cooling air is injected at a spacing, flow volume and velocity that will not damp the pressure fluctuations. Similarly, damping air is necessarily injected at a spacing, flow volume and velocity that will not sufficiently cool the combustor walls.

The surface area of the damper is preferably kept as small as possible to minimise the area lost to cooling and to prevent the area from overheating.

It has been proposed to use Helmholtz resonators to provide damping of acoustic fluctuations and to damp high frequency oscillations, above 2000 Hz, such a device may be used. However, if it is required to damp low frequency oscillations, below 1000 Hz, such a resonator may not be feasibly be used in a gas turbine engine. The size of the resonator required to generate the Helmholtz resonance is inversely proportional to the frequency that it is desired to damp. Consequently, to damp low frequencies, a resonator chamber may be required of a size greater than that of the combustor chamber within which the frequencies are generated. Such a resonator is clearly impractical.

SUMMARY OF THE INVENTION

It is an object of the present invention to address these and other problems and to seek to provide an improved damper arrangement for a combustor. According to a first aspect of the present invention there is provided an acoustic damper component for a combustor, comprising:

a wall having n through-holes for the passage of fluid therethrough, where n>2, the acoustic damper further having isolating means arranged to isolate a selected number m of the through-holes from the plurality of through-holes, wherein m>1 and <n;

the isolating means comprising at least one metering passage communicating with the m isolated through-holes via a first damping chamber and a second damping chamber.

At least one and preferably two or more damping chambers are preferably positioned fluidically between the metering passages and the isolated through holes, a screen with holes, passages or perforations preferably being located between each damping chamber where there are more than one damping chambers.

The acoustic damper component may form part of a combustor in a gas turbine engine and the wall component may define at least part of a combustor wall.

According to a second aspect of the present invention there is provided a combustor having an outer wall having a plurality of outer through-holes; and a co-axial inner wall comprising a plurality of n inner through holes, where n>2;

isolating means isolating a selected number m of the inner through-holes from the plurality of n through-holes, wherein m>1 and <n;

the isolating means comprising at least one metering passage communicating with the m isolated through-holes via a first damping chamber and a second damping chamber;

the outer through-holes being arranged to, in use, supply air to the inner through-holes; and to the isolated inner through-holes through the metering passage.

Preferably the inner and outer walls are separated by pedestals, the walls enclosing a cavity which contains the isolating means. The cavity may be open along at least one edge. The inner wall may be a heat resistant combustor tile that may be secured to the outer wall be a releasable fastening such as a nut and bolt arrangement, for example.

Preferably the isolated through holes and through holes are arranged at an angle to the combustor axis, the angle directing the air passing through the holes axially, radially or circumferentially.

The through holes and isolated through holes may be of different sizes, population and population area. According to a third aspect of the present invention there is provided a method of damping the amplitude of acoustic frequencies below 1000 Hz in a gas turbine combustor comprising the steps of providing the combustor with an acoustic damper according to any one of claims 1 to 6 and passing a flow of fluid through the metering passage, the first damping chamber, the second damping chamber and the m isolated through-holes.

Preferably the volume of the first damping chamber is below that necessary to generate Helmholtz resonance at frequencies below 1000 Hz. Preferably the volume of the second damping chamber is below that necessary to generate Helmholtz resonance at frequencies below 1000 Hz.

Preferably the flow rate of fluid through the isolated through holes is below 20 m/s.

The first metering passage means may comprise a plurality of through holes for allowing a selected volume of fluid into the first damping volume, preferably the plurality of through holes is formed in a first surface of generally planar form.

The first damping volume means may comprise a plurality of isolated volumes, each isolated volume receiving fluid from a number of the plurality of through holes.

The first damping passage means may comprise a perforate screen for allowing a volume of air to pass from the first damping volume means at a selected first damping velocity which may be >3 m/s and <20 m/s. The holes in the perforate screen may be parallel to the plane of the first surface.

The second damping passage means may comprise a perforated screen for allowing a volume of air to pass at a selected second damping velocity and forming at least part of a wall of the second damping volume and possibly passing air at a damping velocity of between 3 m/s and 20 m/s. The second damping passage means may form at least a part of a wall of a combustor.

Preferably the fluid is air.

BRIEF DESCRIPTION OF THE DRAWINGS

The present invention will now be described, by way of example only, with reference to the following figures in which.

DETAILED DESCRIPTION OF THE INVENTION

Figure 1:
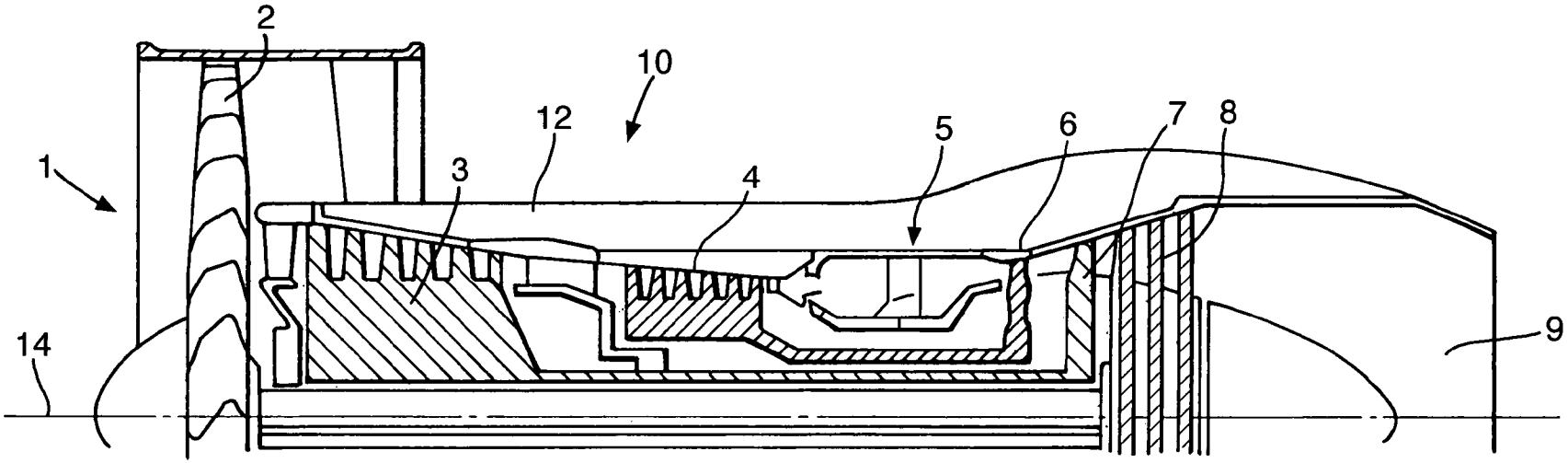
FIG. 1 is a schematic of a gas turbine engine

With reference to FIG. 1, a ducted fan gas turbine engine generally indicated at 10 comprises, in axial flow series, an air intake 1, a propulsive fan 2, an intermediate pressure compressor 3, a high pressure compressor 4, combustion equipment 5, a high pressure turbine 6, an intermediate pressure turbine 7, a low pressure turbine 8 and an exhaust nozzle 9.

Air entering the air intake 1 is accelerated by the fan 2 to produce two air flows, a first air flow into the intermediate pressure compressor 3 and a second air flow that passes over the outer surface of the engine casing 12 and which provides propulsive thrust. The intermediate pressure compressor 3 compresses the air flow directed into it before delivering the air to the high pressure compressor 4 where further compression takes place.

Compressed air exhausted from the high pressure compressor 4 is directed into the combustion equipment 5, where it is mixed with fuel and the mixture combusted. The resultant hot combustion products expand through and thereby drive the high 6, intermediate 7 and low pressure 8 turbines before being exhausted through the nozzle 9 to provide additional propulsive thrust. The high, intermediate and low pressure turbines respectively drive the high and intermediate pressure compressors and the fan by suitable interconnecting shafts.

Figure 2:
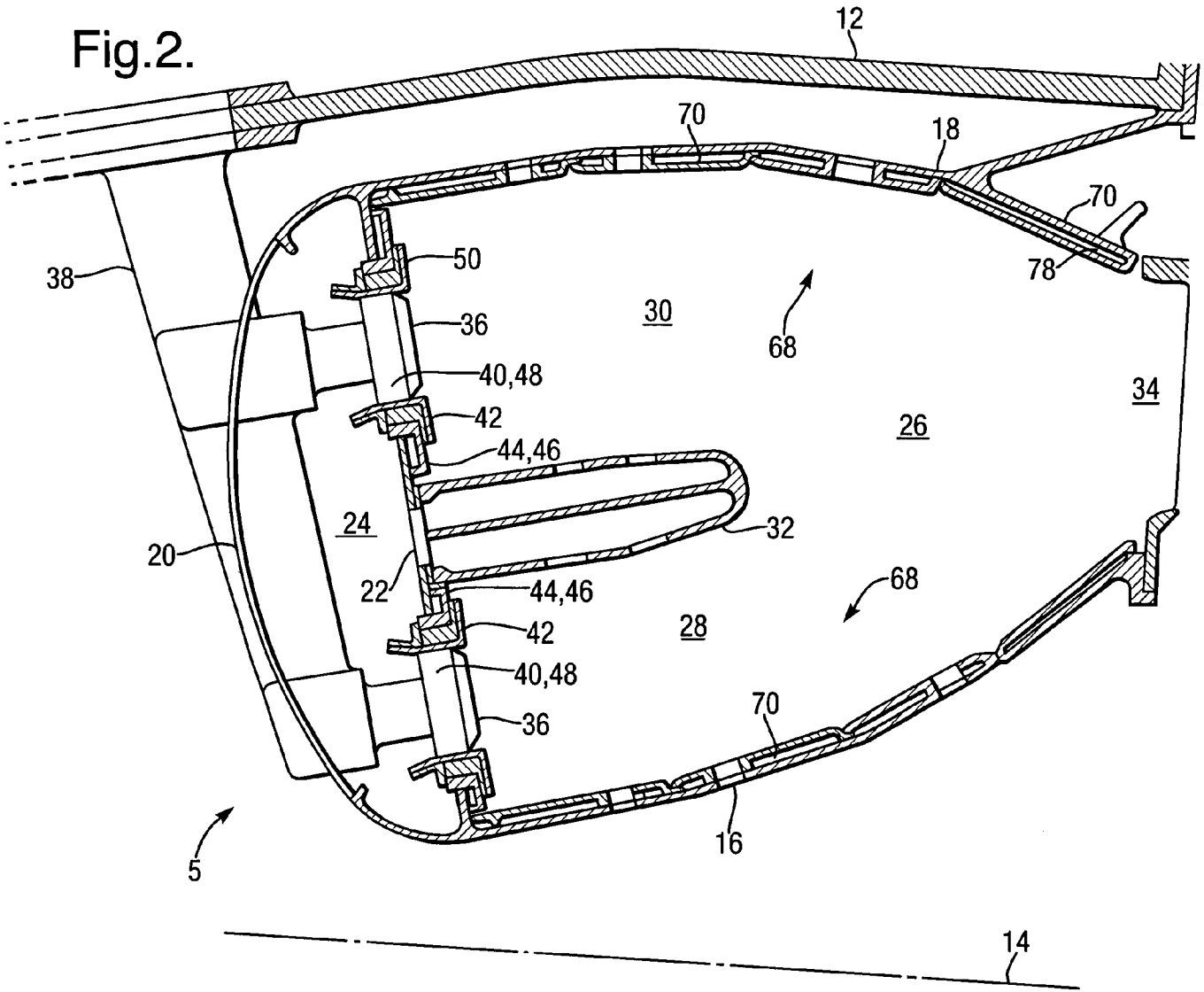
FIG. 2 is a schematic of an annular combustion chamber

In FIG. 2 there is shown, in side section view, a gas turbine engine annular combustor 5 surrounded by a generally cylindrical section of engine casing 12 which is coaxial with the combustor about the engine's longitudinal axis 14.

The combustor is of generally conventional configuration and comprises a pair of radially spaced inner and outer annular sidewalls walls 16 and 18 which are connected at their upstream ends by means of an aerodynamically shaped combustor head portion 20. The sidewalls are further connected by means of an annular bulkhead 22 which extends between the sidewalls 16 and 18 to provide an upstream air entry plenum 24 and a downstream combustion chamber region 26. The combustor shown is of the type configured for low emission staged operation and includes both inner and outer radial combustion zones, 28 and 30 respectively. The inner and outer zones 28 and 30 are separated by means of an annular centre body 32 which extends in a generally axial direction from the annular bulkhead structure 22 towards the combustor exit 34.

In use, air from the upstream compressor enters the plenum chamber 24 through a plurality of inlet apertures formed in the domed shaped head 20, and exits the plenum through a plurality of air spray type fuel delivery nozzles 36 suspended from the engine casing 12. The nozzles 36 are mounted in pairs on radially extending fuel delivery arms 38 which are circumferentially spaced around the combustor head 20 for even distribution. The nozzles are positioned in corresponding fuel nozzle apertures 40 formed in the combustor bulkhead for discharge to the combustion chamber during operation.

An annular seal 42 is positioned between each of the nozzles 36 and the bulkhead apertures 40 to prevent leakage of high pressure combustion air. The seals are slidably mounted with respect to the bulkhead to allow limited radial and axial movement of the nozzles 36 relative to the bulkhead structure. This mounting arrangement provides for unrestrained thermal expansion of the combustor relative to the fuel supply nozzles 36, and as such prevents any unnecessary loading of the components due to differential thermal expansion.

A pair of radially spaced protective heatshield liners 44 are mounted on the downstream face of the bulkhead 22 to provide thermal shielding from combustion temperatures.

Each of the heatshields 44 has an annular configuration made up of a plurality of abutting heatshield or tile segments 46. The segments, which are of substantially identical form, extend both radially towards the centre body 32 and a respective one of the combustor walls 16 and 18, and circumferentially towards adjacent segments to define a fully annular shield. The tile segments are provided with a fuel nozzle aperture 48 for receiving a fuel supply nozzle 36. The fuel nozzle aperture is surrounded by an annular flange 50 which provides for location of the tile on the bulkhead structure.

The inner and outer combustor walls are each provided with an internal heat resistant liner 68 made up of a plurality of heat resistant tile segments 70. The tile segments 70 are arranged row by row, in a contiguous manner, on each of the internal wall surfaces. The inner and outer liners each comprise four rows of similar, but not identical, tile segments 70 which extend circumferentially to form a fully annular liner between the combustor bulkhead 22 and exit 34.

The tiles are spaced a short distance from the combustor walls by flanges or pedestals integrally formed on the underside of the tiles. The flanges are formed around the side edges so that they define an enclosed cavity 78 between the tile and combustor wall.

Ports are formed in the inner and outer combustor annular walls 16,18 and communicate with the enclosed cavity 78. Further ports, or through-holes are formed on the heat resistant tile segments and allow the passage of air from the enclosed cavity into the combustor chamber 28, 30. The primary function of the ports is to provide cooling of the combustor tiles and combustor walls. The pressure outside the combustor is greater than the pressure within the combustor. Therefore air is driven by the pressure differential through the ports and through-holes via the enclosed cavity into the combustor chamber. The volume of cold air passing through the effusion cooling ports is sufficient to create a film of relatively cold air on the combustor-facing surface of the combustor tile.

The effusion holes are angled with respect to the combustor facing surface to direct the flow close to parallel to the combustor facing surface. The film provides an insulating layer and protects the combustor wall by limiting the convective heat transfer. To maintain a uniform film over the length of the combustor facing surface or tile portion a number of axially spaced parallel rows of effusion holes are provided, the axially adjacent rows being positioned at or before the point at which the film fails.

The flow of air through the effusion holes provides a minimal damping function. Instabilities in the combustion process initiate vibrations and waves within the combustor. When a sound wave passes a hole a vortex ring is generated and some of the energy of the sound wave is dissipated into vortical energy that is subsequently transformed into heat energy. The flow through the effusion holes convect the produced vortices into the mainstream flow within the combustor. Whilst the effusion holes and effusion flows provide some damping the mechanisms of effective damping means that the damping is limited.

The ability for a liner to damp is affected by a number of factors including: the velocity of the air through the holes, the surface area over which the damping portions extend, the compliance of the liner and the open area ratio, which is area of the holes divided by the perforate area. Some of these factors such as maintaining an appropriate velocity of air with an appropriate open area ratio are mutually incompatible with the functionality required by a liner providing effusion cooling. This is not affected by the provision of a outer combustor wall that meters the volume of air passing through as the volume of air is then insufficient to provide effective cooling.

It has now been found that the damping ability of the first liner is modified by the provision of a second perforate liner, where the volume separating the two is not sufficiently large to be considered to be a plenum. In this situation, the overall damping ability is a function of the relative compliance and open air ratio of the two liners in addition to the speed of fluid passing through the holes and surface area of the damper.

Figure 3:
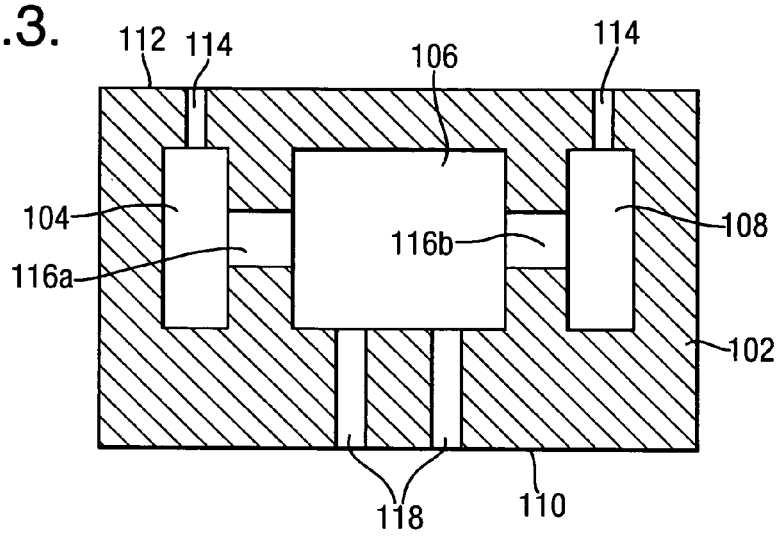
FIG. 3 is a schematic of an acoustic damper according to the present invention.

FIG. 3 depicts a damper in accordance with the present invention. The damper consists of a body having a first planar surface 112 and a second, opposing planar surface 110. The component has dimensions of a size that enables it to be located against a combustor wall or between an inner and an outer combustor wall.

Three separate volumes are contained within the damper component: two first damping volumes 104, 108 and a single second damping volume (106). A plurality of metering holes 114, the number being dependent on the required volumetric flow, extend through the first planar surface 112 and communicate with the first damping volumes 104, 108.

A set of first damping holes 116*a*, 116*b* communicate the first damping volumes 104, 108 with the second damping volume 106. The number, size, and length of these holes are selected such that the flow of air has an optimum damping velocity of between 4 and 20 m/s. The holes 116*a*, 116*b* are short i.e. below 3 mm in length to minimise the effects of inertia on damping.

The damping holes 116*a* and 116*b* are at right angles to the first planar surface 112. This structure reduces the overall foot-print of the damper and minimises the area lost for cooling purposes, as described in greater detail in the description relating to FIG. 4 and 5.

A second set of damping holes 118 leading from the second damping volume communicate with the opposing planar surface 110 of the damper 102. The opposing planar surface is placed against the cold surface of a comubustor wall i.e. the surface of the wall that is remote from the combustion gasses. Each of the second damping holes 118 communicate with a respective hole in the combustor wall. However, a plurality of second damping holes may communicate with a single wall hole.

The number, size, and length of the second damping holes are selected such that the flow of air has an optimum damping velocity of between 4 and 20 m/s. The holes are kept short at around 3 mm in length to minimise the effects of inertia on damping. The pressure disturbance has a wave number k, and the holes a radius a and a pitch d. $ka \ll kd \ll 1$. The radius and the pitch of the holes must be made smaller than the wavelength: $a \ll d \ll \text{wavelength}/2n$.

The damping achieved by the component is shared between the first set of damping holes and the second set of damping holes. The relative dimensions of the holes may be determined empirically to achieve a maximum absorption of up to 83%.

There will be a pressure drop across the first set of damping holes and the second set of damping holes. It is desirable that the pressure drop across each of these sets is substantially the same.

The material of the damper must be capable of withstanding the high temperatures to which it is subject. The material must also have a coefficient of thermal expansion that is similar to the material of the combustor walls. Typically the damper is formed of a ceramic, or nickel alloy. The wall thickness is between 1 and 3 mm.

Figure 4:
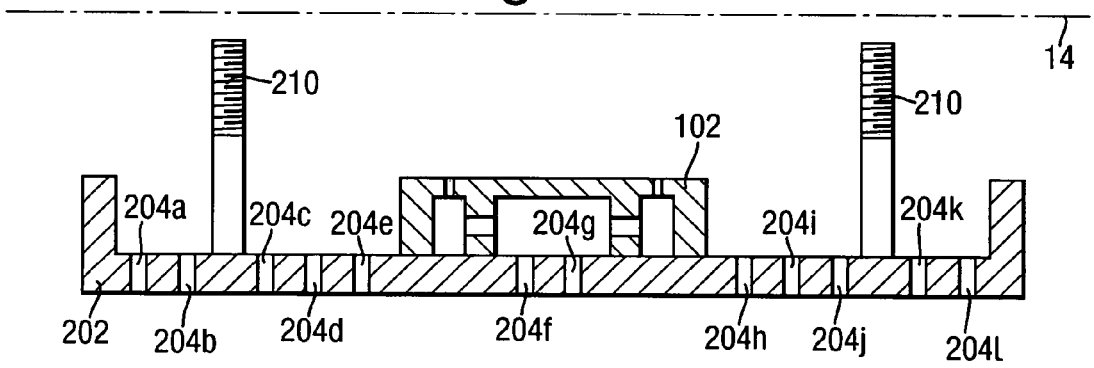
FIG. 4 is a schematic of an acoustic damper mounted to a combustor tile.

FIG. 4 depicts a second embodiment of the present invention. In this embodiment the damper component 102 does not have integrally formed first and second damper chambers. The component 102 is formed with open ended chambers that are closed by the cold surface of a combustor tile. Beneficially, the damper component of this embodiment may be manufactured through a casting or moulding process.

The combustor tile has a number of holes 204*a*-204*l* extending from the cold side to the hot side. The holes 204*a*-204*e* and 204*h* and 204*l* are adapted to be effusion holes. These holes are typically angled with respect to the engine centre line 14 to allow the air flowing therethrough to effectively cool the hot side of the tile.

The holes 204*f* and 204*g* are adapted to be damping holes. These holes have a different form to those of the effusion holes and are isolated from effusion holes by the damper component, which act as an isolating means.

The flow of air through the isolated through holes 204*f*, 204*g* is not of sufficient velocity or volume to sufficiently cool the combustor tile at that point. It is therefore desirable to reduce the surface area that the damper component covers to enable the effusion holes closest to the damper cool that portion of the tile. A cooling film has a finite length where cooling is effective. After this point the film must be replaced by fresh cold air.

By turning the first damping holes through an angle of 90 degrees the surface area that the damper component covers is reduced. Though it will be appreciated that for some arrangements the damping first holes need not be turned through an angle of 90 degrees and the first damping chambers 104 and 108 may be combined as a single damping chamber.

A bolt 210 is attached to the combustor tile and is arranged to connect through an outer wall of the combustor.

Figure 5:
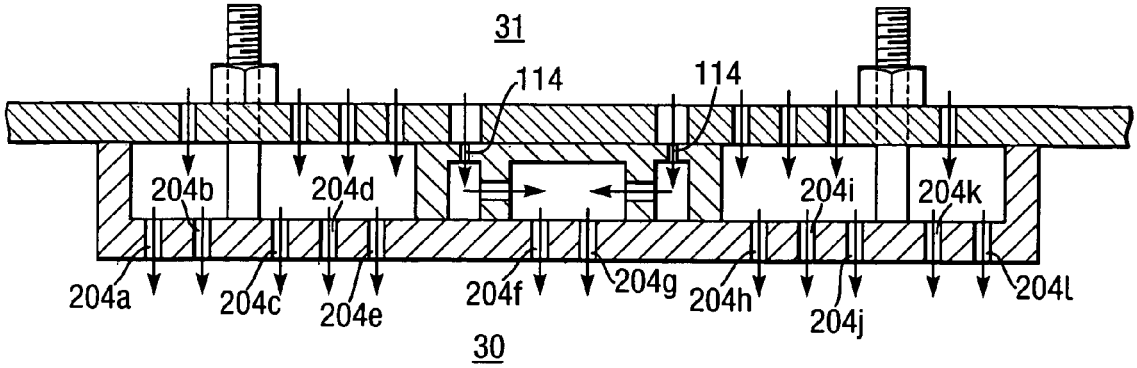
FIG. 5 depicts the combustor tile of FIG. 3 mounted to a combustor wall.

FIG. 5 depicts the damper component attached to the outer wall of a combustor and arrows detailing the flow of fluid.

The operation of the damper component 102 will now be described in greater detail with respect to FIG. 5. The passages and orifices allow a specific mass flow of air to enter the combustor from the second damping passages 204*f* and 204*g* at a specific Mach number and volume. At a low Mach numbers, the air jets issuing from the cooling passages into the combustor respond to small pressure fluctuations across the wall, due to the fluctuating pressure field generated by the combustion instability. This causes a viscous interaction between the air jet and the cooling hole surface, which generates vortices at the cooling hole exit. The vortices are shed from the wall and dissipate as heat.

As the air jets to respond to the fluctuating pressure field, there is an energy transfer to the air jets due to viscosity. This energy transfer causes damping of the combustion instability by reducing the amplitude of the pressure fluctuation. With enough damping, the feed back loop between heat release and pressure can be broken, hence eliminating combustion instability. The level of damping is dependant upon the Mach number of the air jets and the total area of the damping holes.

The metering holes define the air mass flow entering the isolating means, the holes are aligned with holes in the outer wall of the combustor.

Figure 6:
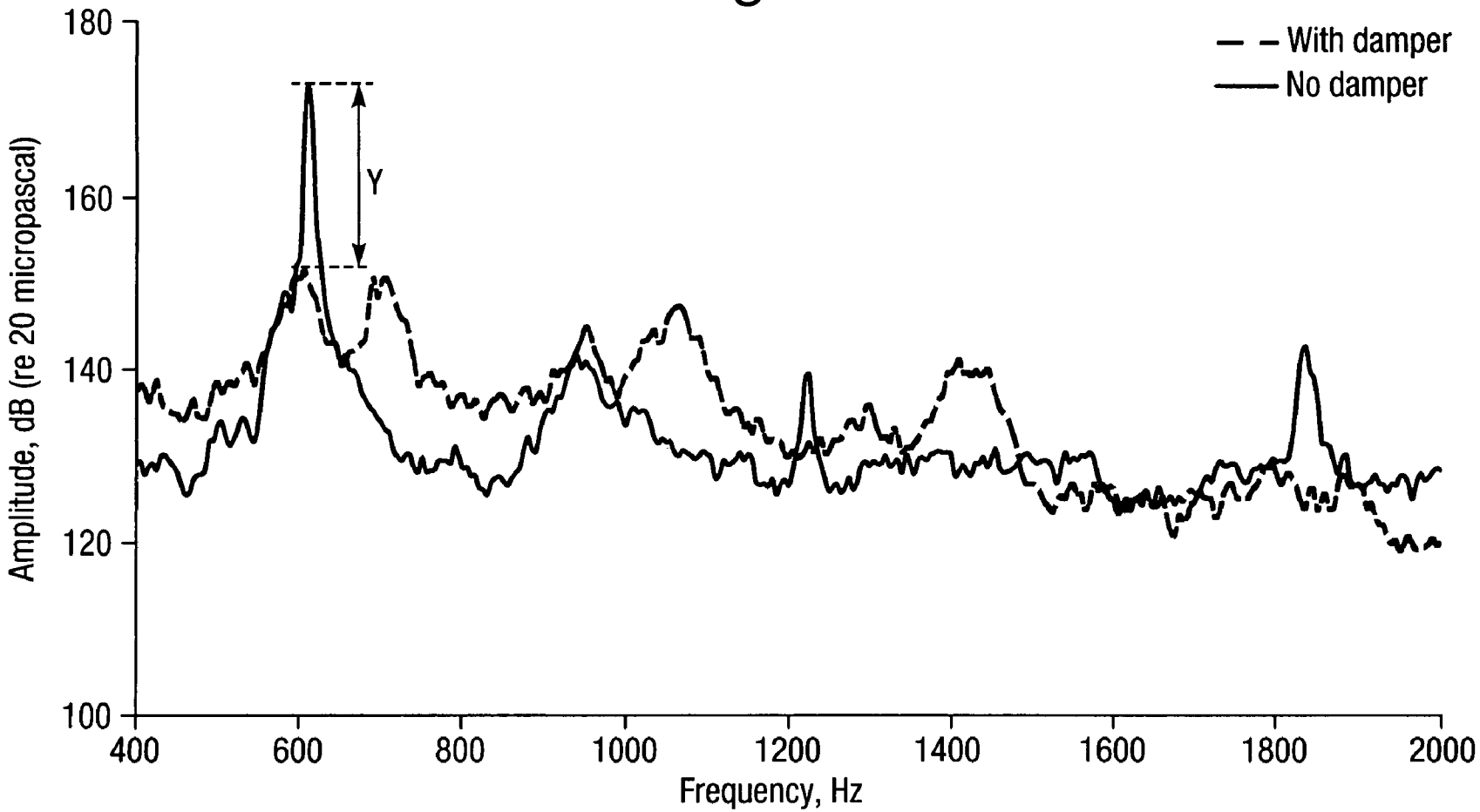
FIG. 6 is a graph of amplitude vs frequency for a damped and un-damped combustor

FIG. 6 depicts the amplitude of a frequency response observed by a gas turbine combustor where it is operated with and without a damper in accordance with the present invention. At 600 Hz the combustor exhibits a high amplitude response that is significantly damped when the damper is in place. The amplitude is reduced by 21 dB.

It will be appreciated that the present invention provides a compact solution for eliminating combustion instability at low frequencies. It has a broad frequency band of operation. This can be integrated within existing combustor cooling technologies and optimised to provide cooling and acoustic damping.

It will also be appreciated that the present invention allows for acoustic damping even where the combuster tile only partially encloses a volume i.e. where the trailing edge of the tile is open to the passage of air.

The acoustic damper may be incorporated in combustor tiles (as shown), within Machined Cooling Rings (MCR's) or as stand alone acoustic dampers attached to the outside of combustor walls. The metering and damping holes may be normal or angled. Angled cooling holes may be used to improve cooling performance while still achieving acoustic damping. The metering and damping devices may be round holes or slots. The metering holes, first damping passages and second damping passages may be arrays of passages. The array may be formed as a single row, or multiple engine axially spaced rows. There may the same or different number of holes, which may be the same or different size, for the metering and damping passages.

We claim:

1. A combustor having an outer wall having a plurality of outer through-holes; and a heat resistant combustor tile providing a co-axial inner wall comprising a plurality of n inner through holes, where n>2;

isolating means isolating a selected number m of the inner through-holes from the plurality of n through-holes, wherein m>1 and <n;

the isolating means comprising at least one metering passage communicating with the m isolated through-holes via a first damping chamber and a second damping chamber;

the outer through-holes being arranged to, in use, supply air to the inner through-holes; and to the isolated inner through-holes through the metering passage.

2. A combustor according to claim 1, wherein the inner wall and outer wall are separated by pedestals.

3. A combustor according to claim 1, wherein the inner wall and outer wall enclose a cavity, the isolating means being located within the cavity.

4. A combustor according to claim 1, wherein the heat resistant combustor tile is attached to the outer wall by a releasable fastener.

5. A combustor according to claim 4, wherein the releasable fastener is a nut and bolt arrangement.

6. A combustor according to claim 1, wherein the combustor has an axis and a radius extending from the axis, the inner through-holes being arranged at an angle to both the combustor axis and the radial direction.

7. A combustor according to claim 1, wherein the combustor has a circumference, the inner through-holes being angled circumferentially.

8. A combustor according to claim 1, wherein the isolating means further comprises a damping passage connecting the first damping chamber with the second damping chamber.

9. A combustor according to claim 8, wherein the damping passage has a length between 1 mm and 3 mm.

10. A combustor according to claim 8, wherein the inner wall is substantially planar and the damping passage extends parallel thereto

* * * * *